US008051525B2

(12) United States Patent
Bernat Bernat

(10) Patent No.: US 8,051,525 B2
(45) Date of Patent: Nov. 8, 2011

(54) HAIR BRUSH

(75) Inventor: Josep Maria Bernat Bernat, Barcelona (ES)

(73) Assignee: Dols Industrial De Peluqueria, S.A., Barcelona (ES)

( * ) Notice: Subject to any disclaimer, the term of this patent is extended or adjusted under 35 U.S.C. 154(b) by 907 days.

(21) Appl. No.: 11/988,574

(22) PCT Filed: Apr. 24, 2006

(86) PCT No.: PCT/ES2006/000200

§ 371 (c)(1),
(2), (4) Date: Jan. 10, 2008

(87) PCT Pub. No.: WO2007/010058

PCT Pub. Date: Jan. 25, 2007

(65) Prior Publication Data

US 2009/0165234 A1 Jul. 2, 2009

(30) Foreign Application Priority Data

Jul. 18, 2005 (ES) ..... 200501740

(51) Int. Cl.
*A46B 1/00* (2006.01)

(52) U.S. Cl. ..... 15/160; 15/168; 15/206; 132/120

(58) Field of Classification Search ..... 15/160, 15/206, 168, 164, 207.2; 132/120
See application file for complete search history.

(56) References Cited

U.S. PATENT DOCUMENTS

| | | | | |
|---|---|---|---|---|
| 4,936,633 | A * | 6/1990 | Weihrauch | 300/21 |
| 5,427,120 | A * | 6/1995 | Wong | 132/120 |
| 5,615,439 | A * | 4/1997 | Bourrelly | 15/104.2 |
| 6,070,597 | A * | 6/2000 | Motherhead | 132/262 |
| 6,098,635 | A | 8/2000 | Marino | |
| 6,153,304 | A * | 11/2000 | Smith et al. | 428/447 |
| 6,382,216 | B1 | 5/2002 | Clark | |
| D621,163 | S * | 8/2010 | Rennette | D4/128 |
| 2004/0177864 | A1 * | 9/2004 | Segalla | 134/8 |

FOREIGN PATENT DOCUMENTS

| | | |
|---|---|---|
| EP | 1310187 A2 * | 5/2003 |
| ES | 1 049 859 | 2/2002 |
| WO | WO 03/024271 | 3/2003 |

OTHER PUBLICATIONS

International Search Report dated Sep. 13, 2006.

* cited by examiner

*Primary Examiner* — Shay Karls
(74) *Attorney, Agent, or Firm* — Jacobson Holman, PLLC

(57) ABSTRACT

A brush is made up of: a handle an aluminum tubular body which is coated with an artificial plastic material, vinyl fluoride polymer, and holes with polygonal shape, arranged in a herringbone pattern, which end in bevelling and are arranged forming oblique lines in respect of the longitudinal axis of the brush. Nylon fibers are ionized by radiation, and are fixed helicoidally to a supporting center rod, located inside the tubular body. The fibers emerge through the holes of the tubular body, and a front top closes the fore end of the tubular body.

4 Claims, 3 Drawing Sheets

HAIR BRUSH

This is a national stage of PCT/ES06/000200 filed Apr. 24, 2006 and published in Spanish.

OBJECT OF THE INVENTION

This invention is about a hair brush like the ones used for hair straightening and soft perms which feature: a handle, a holed tubular body through which emerge fibers that are fixed helicoidally to a support center, and an upper top that closes the fore end of the said tubular body.

BACKGROUND OF THE INVENTION

Nowadays the use of hair brushes is common for hair brushing and soft perms either at home or in hairdressing and beauty salons. An example of commonly used brushes in hairdressing salons are the ones which comprise a hollow and holed tubular body which has a handle for it to be held on one end and a top to close it on its other end. Inside this tubular body are a bunch of fibers arranged helicoidally which come out through the holes of the tubular body. This kind of brush allows making a soft perm and a hairdo while applying heat.

In these brushes the tubular body is made in aluminum coated or not with ceramic which allows the accumulation and transmission of calories provided by an external heat source, generally a hairdryer.

When the tubular body is coated with ceramic it accumulates calories for more time than just aluminum but transmits heat with less speed and effectiveness. Another known inconvenience of this kind of brush is that the hair products applied adhere on the tubular body little by little thus avoiding a smooth and uniform sliding of hair on the tubular body.

Furthermore, another inconvenience of this kind of brush lies in the fibers when emerging through the holes of the tubular body because they do not come out perpendicularly to it due to the fact that normally the holes are circular which cause most of the fibers to lean slightly avoiding the hair sliding smoothly over the brush and making effective contact with the surface of the tubular body, reducing thus the effectiveness of the brush notably, especially during the straightening and soft perm works. In this kind of brush the holes of the tubular body are generally made by means of a die cut on an aluminum plate and during this process little imperfections remain all around the edges of the holes on one of the sides of the aluminum plate.

The presence of these imperfections becomes an important problem during the assembly of the different pieces that compound the brush or during the use of it, because in the case of these imperfections remaining at the internal side of the tube they become a means of retention for the fibers to come out through the tubular body, whereas in the case that the imperfections are on the external side of the tubular body they are so jagged that can damage the hair cuticle.

If it is preferred that the little imperfections are left on one concrete side of the tubular body, the aluminum plates from which the tubular bodies of the brushes will be shaped must be placed in a given position, then the imperfections can be all on the same side, but it slows down the manufacturing process.

SUMMARY OF THE INVENTION

The brush of this invention presents a series of technical features that allow a more effective and optimized use of it providing also a longer durability.

According to the invention, the brush features an aluminum tubular body having holes and coated externally with an artificial plastic material with non-stick properties, with a high capacity of heat transmission and resistant to chemical and physical agents, being polytetrafluorethylene, also known as Teflon®.

Given that the aluminum is a good conductive material for heat, a homogeneous distribution of heat applied by means of a hair drier or similar can be achieved.

Furthermore, the coating of polytetrafluorethylene makes the time of heat transfer to be prolonged and provides a proper protection against the damage of the brush caused by the action of components in products applied on the hair, giving thus a longer useful life to the brush. Additionally, due to the non-stick properties of this coating material, a smooth sliding of hair over the tubular body of the brush is granted avoiding thus any pulling of the hair and also seals the hair cuticle obtaining thus as a result a more brilliant and reinforced hair than with the use of conventional brushes.

According to the invention, the holes made on the tubular body, through which the fibers come out, present a polygonal shape, in concrete a rhomboidal shape, and are arranged in a herringbone pattern so that the fibers can come out easily during the assembly of the brush. This feature also makes that the fibers are perpendicular to the tubular body providing thus a better brushing.

In order to facilitate even more the coming out of the fibers through the holes of the tubular body during the assembly of the brush, this brush presents specific characteristics, underlying: on one hand, that the holes are arranged in oblique lines in respect of the longitudinal axis of the brush, being the space between these polygonal holes equal or less than to 2 millimeters with which the weight of the brush is reduced as well as making it more handy and on the other hand, that the imperfections caused by the holes on both sides of the aluminum plate are bevelled.

The internal bevelling favors the coming out of the fiber through the holes of the tubular body while the external bevelling avoids the presence of jagged imperfections on the external surface of the tubular body which can damage the hair cuticle.

The fibers of the brush are made of nylon ionized by means of radiation, which provides more strength and resistance to them during its use due to the alteration produced in their molecular structure during the radiation. The use of these ionized fibers favors the sliding of hair among them, avoiding the accumulation of static in the hair and therefore the undesirable effects that carries such accumulation.

BRIEF DESCRIPTION OF THE DRAWINGS

In order to complete the present description and with the aim to facilitate the understanding of the characteristics of the invention, a set of drawings is enclosed hereby in which with an illustrative end and not limitative, the following is represented.

DETAILED DESCRIPTION OF THE PREFERRED EMBODIMENTS

Figure 1:
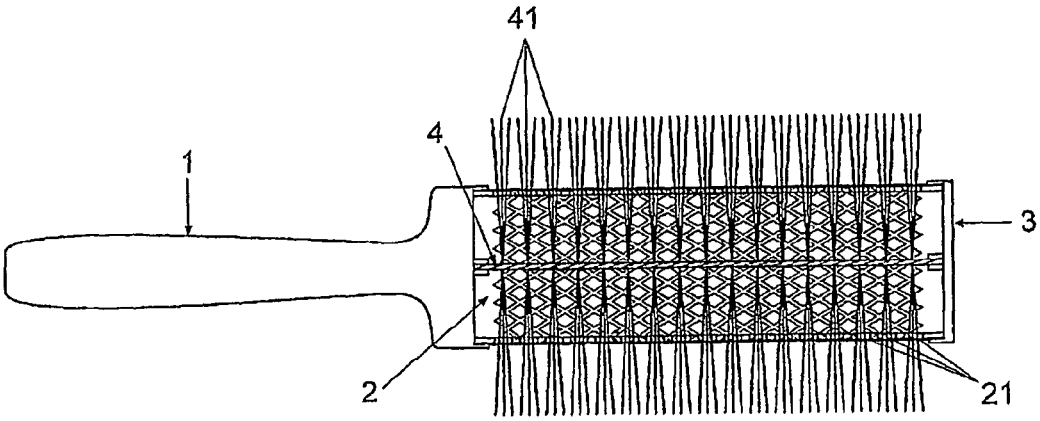
FIG. 1 shows the raised brush sectioned longitudinally by a vertical plane.
Figure 2:
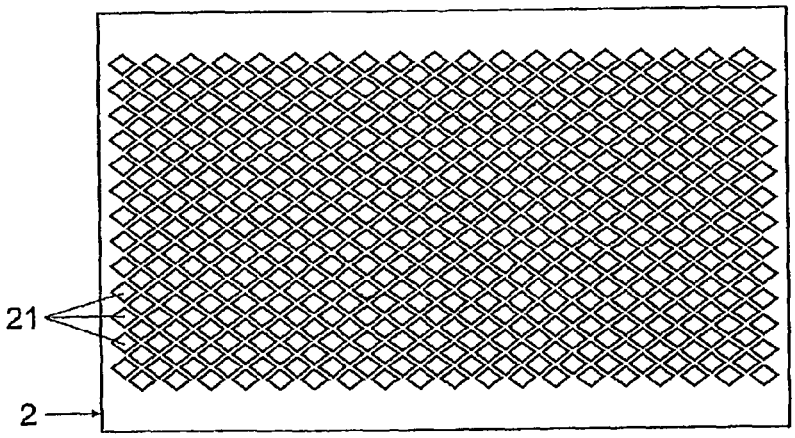
FIG. 2 shows a horizontal plane of a holed aluminum plate from which the tubular body of the brush is shaped.
Figure 3:
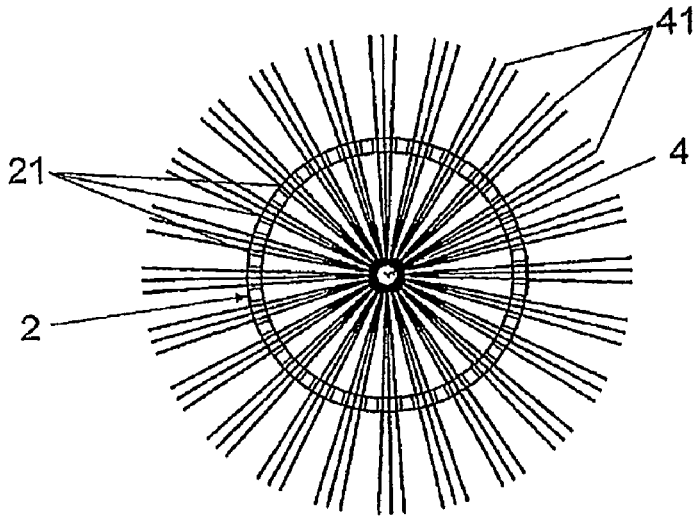
FIG. 3 shows a transversal plane of the brush in a part coincident with the tubular body.

As it can be seen in the figures, the brush is featured by a handle (1) assembled by a mouthpiece to a tubular body (2) that is hollow with the surface holed, being closed at the opposed side of this same tubular body (2) with a top (3) and having a center rod (4) inside it around which a bunch of fibers (41) are arranged helicoidally.

The fibers (41) come out through the holes (21) of the tubular body (2). The fibers (41) are made up of nylon bristles ionized through radiation.

The tubular body (2) is made of an aluminum plate coated externally with polytetrafluorethylene. The holes (21) present a rhomboid shape and are arranged in a herringbone pattern, forming oblique lines in respect of the longitudinal axis of the brush and with a space among them equal or less than 2 millimeters.

Figure 4:
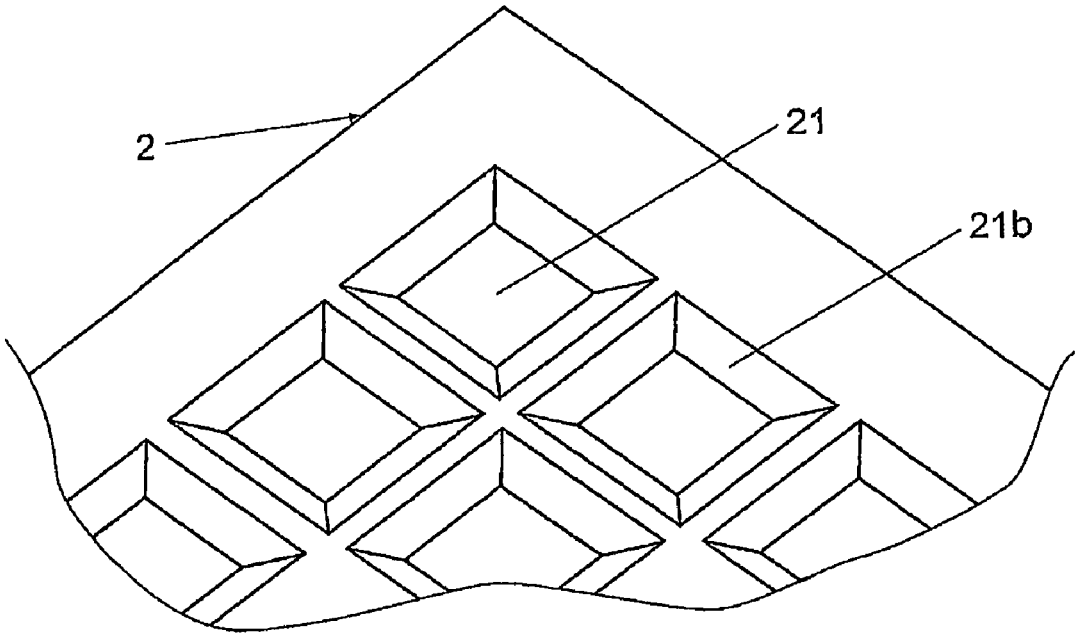
FIG. 4 shows a detail in perspective of the external bevelling of the holes on the tubular body.
Figure 5:
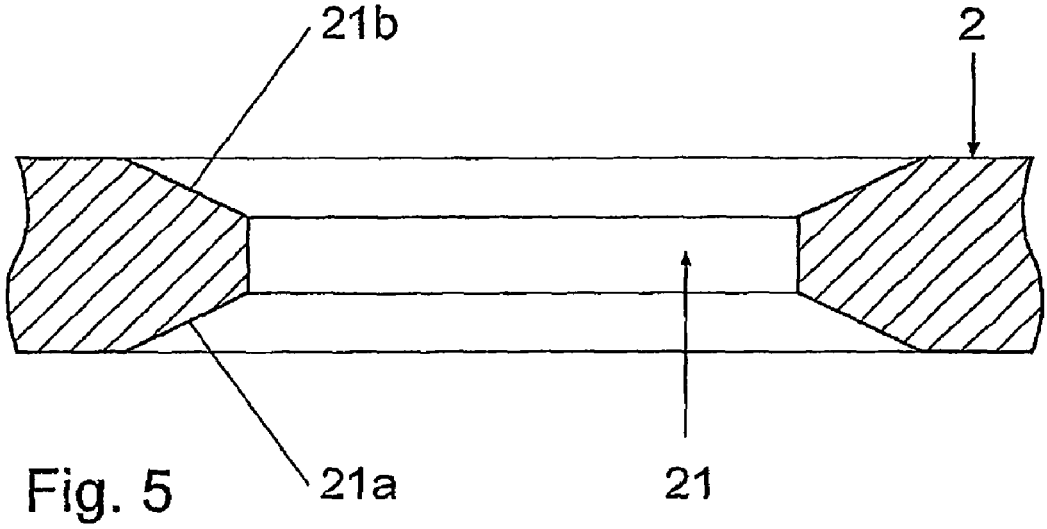
FIG. 5 shows a transversal sectioning of one of the holes of the tubular body, allowing thus to observe the internal and external bevelling of the said hole.

As it can be seen in FIGS. 4 and 5, the edges of the holes (21) either on the inside or the outside of the tubular body (2) are bevelled, ending these holes (21) in both respective bevelling (21*a* and 21*b*).

The internal bevelling (21*a*) favors the access of the fibers (41) to the holes (21) during the assembly of the brush and their coming out from it, while the external bevelling (21*b*) avoids the jagged edges on the external surface of the tubular body (2) which may damage hair cuticles.

Once described sufficiently the aim of the invention, as well as an example of a preferred carrying out of the same, it is underlined that the materials, shape, size and disposition of the described elements can be modified, provided that it do not mean an alteration of the characteristics of the invention which are claimed as follows.

The invention claimed is:

1. A hair brush comprising a handle, a tubular body mounted on the handle, the tubular body having polygonal shaped holes, hair brush fibers fixed at one end helicoidally to a center support of the tubular body, and a front top closing a fore end of the tubular body, the tubular body being made of an aluminum plate having, at least on an external surface thereof, a coating of vinyl fluoride polymer, with non-stick properties and with a high resistance to chemical agents, the polygonal shaped holes defined in the tubular body being of a polygonal shape and being arranged in a herringbone pattern, forming oblique lines with respect to a longitudinal axis of the tubular body, edges of the polygonal shaped holes at an internal surface and the external surface of the tubular body including bevelled surfaces, the bevelled surfaces of the polygonal shaped holes each respectively extend from the internal surface and the external surface of the tubular body and terminate at a center region of a cross-section of the tubular body in an unobstructed annular region of parallel extending sidewalls, terminal portions of the bevelled surfaces located at the center region being spaced away from each other, the hair brush fibers extend from the center support through the polygonal shaped holes of the tubular member and terminate spaced outwardly of the tubular member.

2. The hair brush according to claim 1, wherein the holes are rhomboid holes.

3. The hair brush, according to claim 1, wherein a distance between adjacent polygonal shaped holes is equal to or less than 2 millimeters.

4. The hair brush according to claim 1, wherein the hair brush fibers are made of nylon bristle ionized by radiation.

* * * * *